US006824361B2

(12) United States Patent
Yu et al.

(10) Patent No.: US 6,824,361 B2
(45) Date of Patent: Nov. 30, 2004

(54) AUTOMOTIVE FUEL PUMP IMPELLER WITH STAGGERED VANES

(75) Inventors: DeQuan Yu, Ann Arbor, MI (US); Paul Edward Fisher, Dexter, MI (US); Stephan Thomas Kempfer, Canton, MI (US); Norman N. Krieger, Milford, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 29 days.

(21) Appl. No.: 10/202,218

(22) Filed: Jul. 24, 2002

(65) Prior Publication Data

US 2004/0018080 A1 Jan. 29, 2004

(51) Int. Cl.[7] ..... F04D 5/00

(52) U.S. Cl. ..... 416/203; 416/237; 415/55.1

(58) Field of Search ..... 415/55.1; 416/237, 416/175, 203, 235

(56) References Cited

U.S. PATENT DOCUMENTS

| | | | | |
|---|---|---|---|---|
| 1,865,504 A | * | 7/1932 | Bird | 415/55.1 |
| 3,947,149 A | | 3/1976 | MacManus | |
| 4,204,802 A | | 5/1980 | Schönwald et al. | |
| 4,408,952 A | | 10/1983 | Schweinfurter | |
| 4,881,871 A | * | 11/1989 | Wunderlich | 416/203 |
| 4,915,582 A | | 4/1990 | Nishikawa | |
| 4,923,365 A | * | 5/1990 | Rollwage | 415/55.1 |
| 5,123,809 A | | 6/1992 | Ito | |
| 5,209,630 A | | 5/1993 | Roth | |
| 5,215,429 A | | 6/1993 | Sun | |
| 5,257,916 A | | 11/1993 | Tuckey | |
| 5,265,996 A | | 11/1993 | Westhoff et al. | |
| 5,273,394 A | | 12/1993 | Samuel | |
| 5,302,081 A | * | 4/1994 | Smith | 415/55.1 |
| 5,372,475 A | | 12/1994 | Kato et al. | |
| 5,407,318 A | | 4/1995 | Ito et al. | |
| 5,413,457 A | | 5/1995 | Tuckey | |
| 5,498,124 A | | 3/1996 | Ito et al. | |
| 5,507,617 A | | 4/1996 | Sun | |
| 5,549,446 A | * | 8/1996 | Gaston et al. | 415/55.1 |
| 5,716,191 A | | 2/1998 | Ito et al. | |
| 5,975,843 A | | 11/1999 | Ebihara | |
| 6,227,819 B1 | | 5/2001 | Gettel et al. | |
| 6,231,318 B1 | | 5/2001 | Cotton et al. | |
| 6,296,439 B1 | | 10/2001 | Yu et al. | |
| 6,299,406 B1 | * | 10/2001 | Yu et al. | 415/55.1 |
| 6,322,319 B1 | | 11/2001 | Yoshioka | |
| 6,425,733 B1 | * | 7/2002 | Ross | 415/55.1 |
| 6,471,466 B2 | * | 10/2002 | Marx et al. | 415/55.1 |
| 6,511,283 B1 | * | 1/2003 | Yoshioka | 415/55.1 |
| 2001/0028844 A1 | | 10/2001 | Narisako et al. | |
| 2001/0036400 A1 | | 11/2001 | Kobayashi et al. | |

FOREIGN PATENT DOCUMENTS

| | | |
|---|---|---|
| EP | 1 134 425 A3 | 4/2002 |

* cited by examiner

*Primary Examiner*—Edward K. Look
*Assistant Examiner*—Richard A Edgar
(74) *Attorney, Agent, or Firm*—Brinks Hofer Gilson & Lione

(57) ABSTRACT

An impeller for a fuel pump for supplying fuel to an automotive engine from a fuel tank includes an impeller body having a substantially disk shape with opposing first and second faces and an outer circumference. The impeller body defines a rotational axis extending therethrough perpendicular to the first and second faces. A plurality of radially outwardly extending vanes extend from the outer circumference of the impeller body and are spaced circumferentially about the impeller body. Each of the vanes includes a first half extending from the outer circumference adjacent the first face and a second half extending from the outer circumference adjacent the second face. The second halves are rotationally shifted about the rotational axis relative to the first halves. The vanes are spaced un-evenly and in a non-repeating pattern about the outer circumference of the impeller body.

22 Claims, 6 Drawing Sheets

AUTOMOTIVE FUEL PUMP IMPELLER WITH STAGGERED VANES

TECHNICAL FIELD OF THE INVENTION

The present invention generally relates to automotive fuel pumps, and more particularly to a regenerative turbine type rotary impeller.

BACKGROUND

Regenerative fuel pumps that have an impeller with a ring extending around the outer diameter have been widely used in automotive applications because of their robust manufacturing, low cost, and high efficiency. These features are emphasized in low voltage, high pressure applications. However, this impeller design exhibits "disadvantageous" characteristics when used in an Electrical Returnless Fuel System (ERFS). When the vehicle is at idle, the fuel pump of an ERFS typically spins at approximately 3,000 to 4,000 revolutions per minute (rpm), while the fuel pump of a traditional system spins at approximately 8,000–9,000 rpm. At the lower rpm rate, the impeller exhibits pressure pulsation noise in the fuel pump.

Therefore, there is a need for a fuel pump having an impeller which dampens the pressure pulsation within the fuel pump while maintaining the efficiency advantages of the ring impeller.

DETAILED DESCRIPTION OF THE PREFERRED EMBODIMENTS

The following description of the preferred embodiment of the invention is not intended to limit the scope of the invention to this preferred embodiment, but rather to enable any person skilled in the art to make and use the invention.

Figure 1:
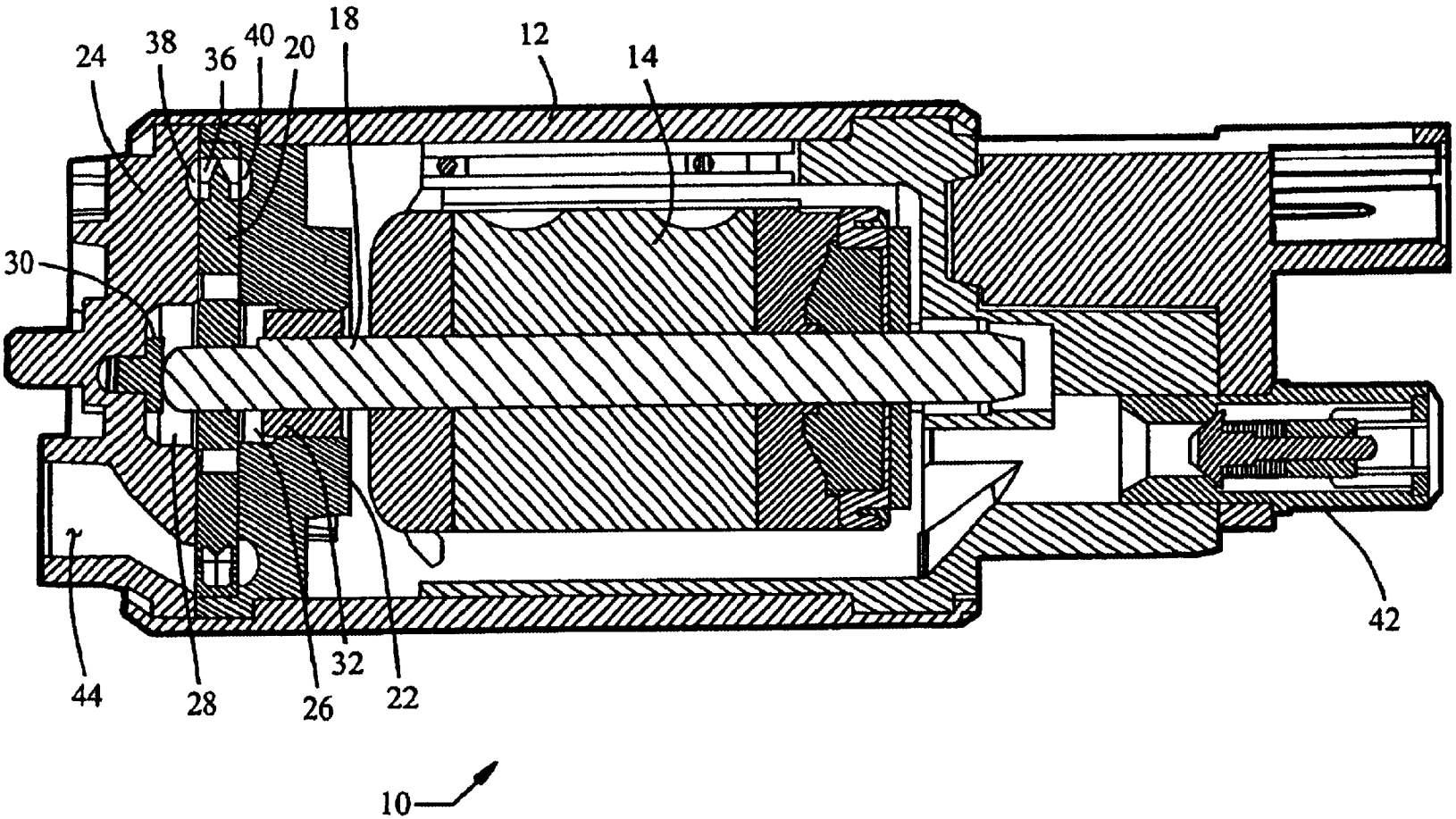
FIG. 1 is a sectional view of a fuel pump of the present invention.

Referring to FIG. 1, a fuel pump of the present invention is generally shown at 10. The fuel pump 10 includes a housing 12 and a motor 14 mounted within the housing 12. Preferably, the motor 14 is an electric motor with a shaft 18 extending therefrom. An impeller 20 is fitted onto the shaft 18 and is encased within the pump housing 12 between a pump body 22 and a pump cover 24. The impeller 20 fits onto the shaft 18 such that the impeller 20 is free to move axially along the shaft 18 and rotates with the shaft 18. Therefore, the impeller 20 "floats" between the pump cover 24 and the pump body 22. The fuel pump is of a conventional type which is further described in U.S. Pat. Nos. 6,210,102; 6,296,439; and 6,299,406, which are all commonly assigned to the same assignee as the present application and are hereby incorporated by reference into the present application.

The impeller 20 has a central axis which is coincident with the axis of the shaft 18. The shaft 18 passes through a shaft opening 26 in the pump body 22, through the impeller 20, into a cover recess 28, and abuts a thrust button 30. The shaft 18 is journalled within a bearing 32. A pumping chamber 36 is formed along the periphery of the impeller 20 by an annular cover channel 38 of the pump cover 24 and an annular body channel 40 of the pump body 22. The pump body 22 has a fuel outlet (not shown) leading from the pumping chamber 36. Pressurized fuel is discharged through the fuel outlet 34 to and cools the motor 14 while passing over the motor 14 to a pump outlet 42 at an end of the pump 10 which is axially opposite a fuel inlet 44.

Figure 2:
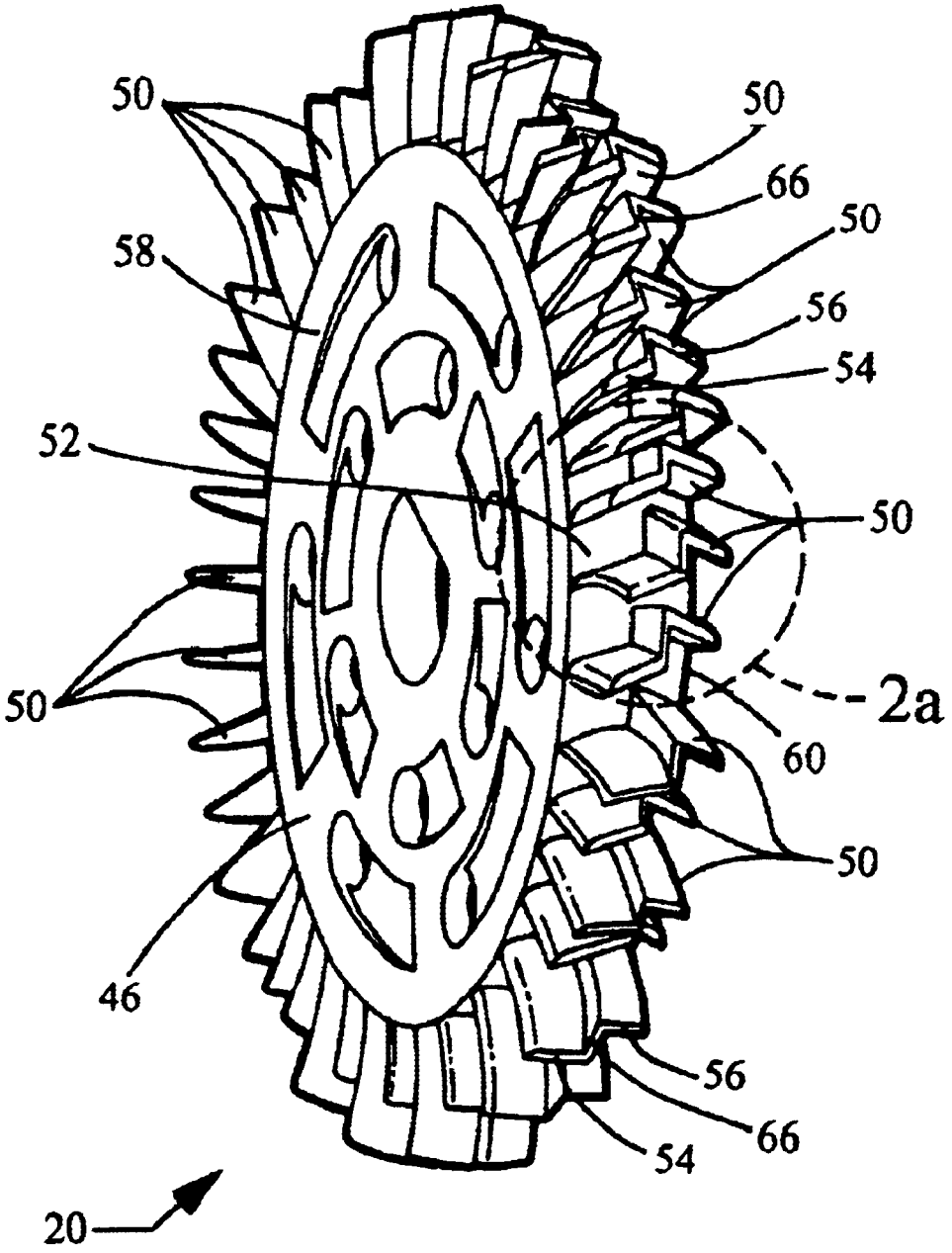
FIG. 2 is a perspective view of first preferred embodiment of an impeller from the fuel pump shown in FIG. 1.

Referring to FIG. 2 the impeller 20 has an impeller body 46 which is substantially disk shaped. The impeller body 46 includes a plurality of vanes 50 extending radially outward from an outer circumference 52 of the impeller. Preferably, the number of vanes 50 is a prime number, and the vanes 50 are un-evenly spaced around the outer circumference 52 of the impeller 20. In other words, the distance between any two adjacent vanes 50 is not a constant, and varies in a non-repeating pattern about the circumference of the impeller 20. By having a prime number of vanes 50 and spacing them un-evenly, harmonic pulsations are reduced within the impeller 20. Further, the pattern of the spacing of the vanes 50 is a non-repeating pattern to further reduce harmonic pulsations.

Figure 2A:
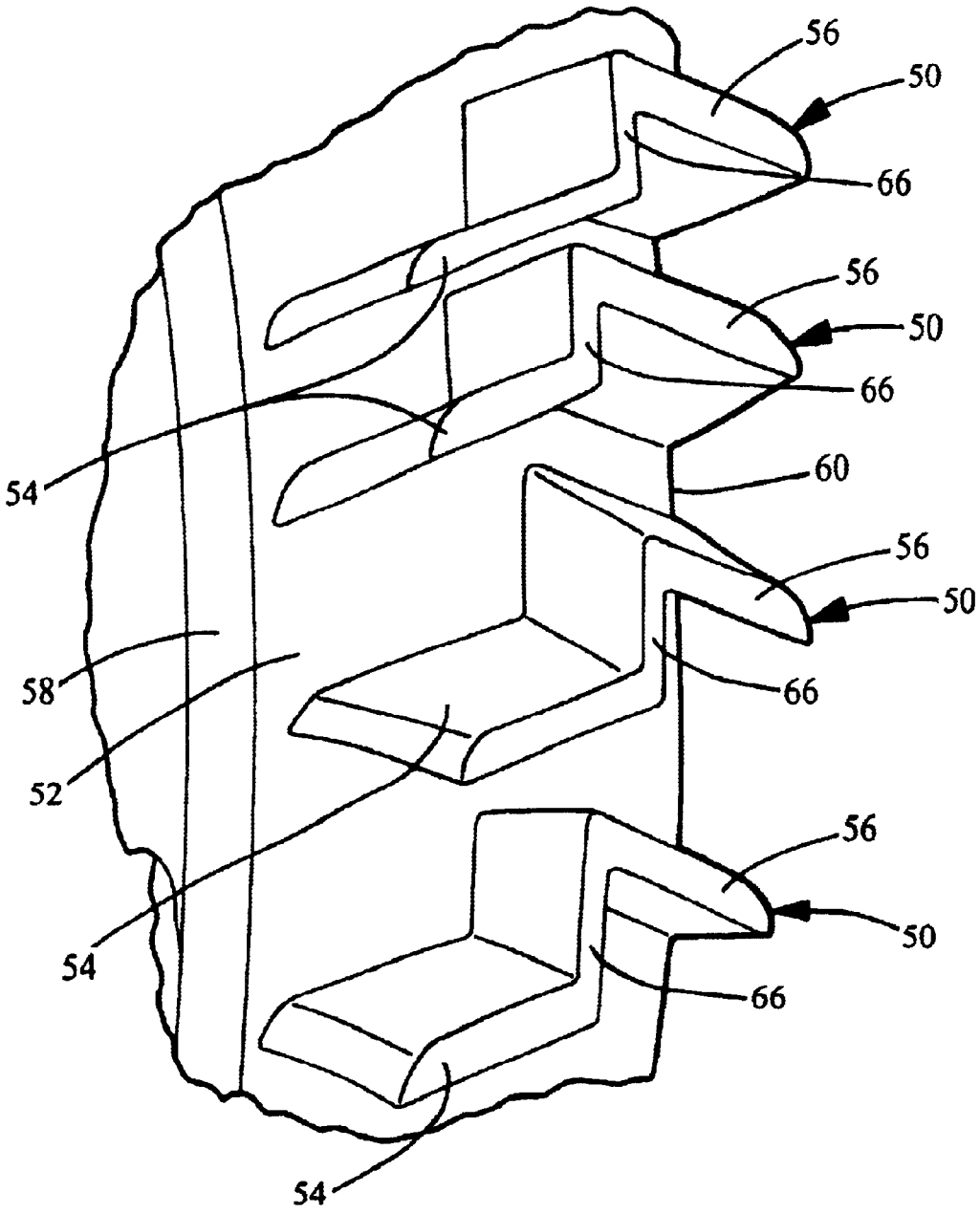
FIG. 2*a* is an enlarged portion of FIG. 2.

Referring to FIG. 2*a*, each vane 50 includes a first half 54 and a second half 56. The first half 54 extends outward radially from the outer circumference 52 adjacent a first face 58 of the impeller 20, and the second half 56 extends outward radially from the outer circumference 52 adjacent a second face 60 of the impeller 20. The second half 56 of each of the vanes 50 is shifted rotationally relative to the first half 54. Preferably, the second half 56 of each vane is shifted approximately half the distance between the first half 54 of that vane 50 and the first half 54 of the next adjacent vane 50. Said differently, each second half 56 is spaced half way between two adjacent first halves 54.

Preferably, each of the vanes 50 includes a radially outwardly extending connector wall 66. The connector wall 66 extends radially from the outer circumference 52 of the impeller body 46 and extends circumferentially between the first and second halves 54, 56 of the vane 50. The radial height of the connector wall 66 is the same as the radial height of the first and second halves 54, 56 between which the connector wall 66 extends.

Figure 3:
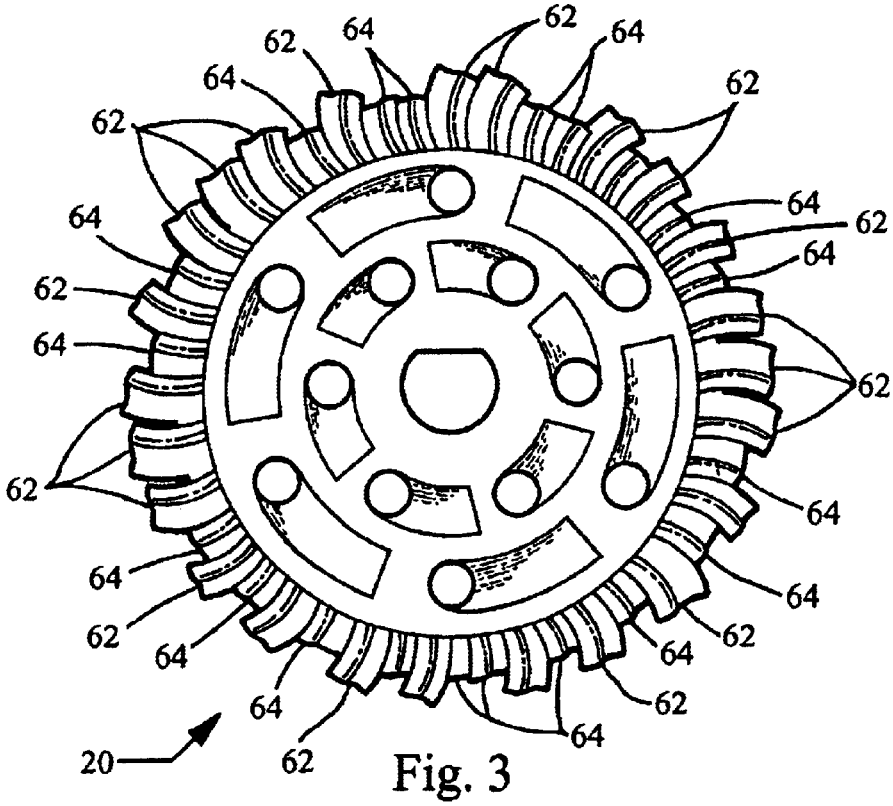
FIG. 3 is side view of the impeller shown in FIG. 2.

Referring to FIG. 3, the vanes 50 can be divided into two different groups of first vanes 62 and second vanes 64. First vanes 62 have a first radial height, and second vanes 64 have a second radial height. Preferably, the radial height of the second vanes 64 are approximately two-thirds the height of the first vanes 62. The first and second halves 54, 56 of any single vane 50 preferably have the same radial height.

The first and second vanes 62, 64 are spaced and intermingled with one another about the outer circumference 52 of the impeller body 46. Similar to the spacing of the vanes 50, the pattern of the intermingled first and second vanes 62, 64 is preferably a non-repeating pattern. Additionally, preferably the number of first vanes 62, having the first radial height, is a prime number.

Figure 4:
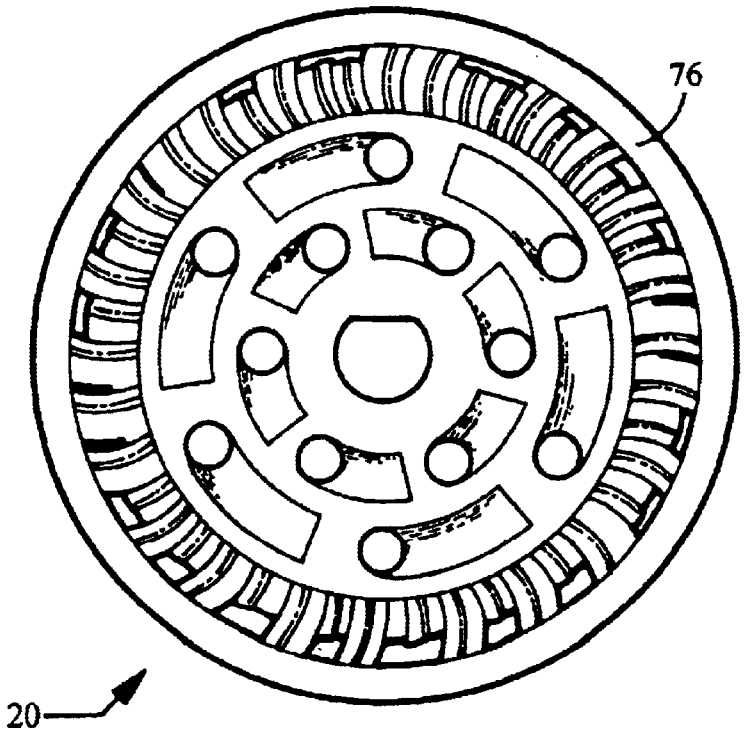
FIG. 4 is a side view similar to FIG. 3 of a second preferred embodiment of the impeller.

Referring to FIG. 4, a second preferred embodiment of the impeller includes a ring portion 76 around the outer circumference 52 connected to the vanes 50. In the second preferred embodiment, the first radial height is such that the first vanes 62 extend fully outward from the outer circumference 52 of the impeller body 46 and connect to the outer ring portion 76. The second radial height is less than the first radial height, such that the second vanes 64 of the second group extend outward from the outer circumference 52 of the impeller body 46 and do not extend fully out to connect with the outer ring 76.

Figure 4A:
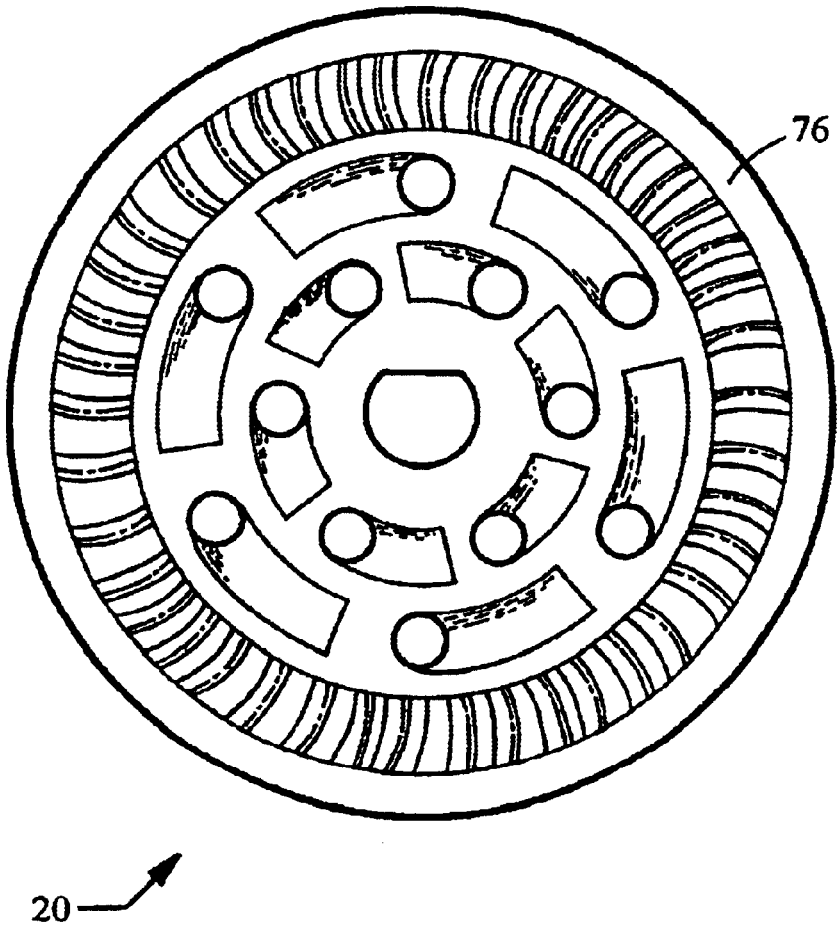
FIG. 4*a* is a side view similar to FIG. 4 wherein all of the vanes have the same radial height.

The impeller 20, with the outer ring portion 76, can include first and second vanes 50 as shown in FIG. 4, or alternatively, the impeller 20, having the outer ring portion 76, can include only vanes 50 which extend radially outward and connect with the outer ring portion 76, as shown in FIG. 4*a*.

Figure 5:
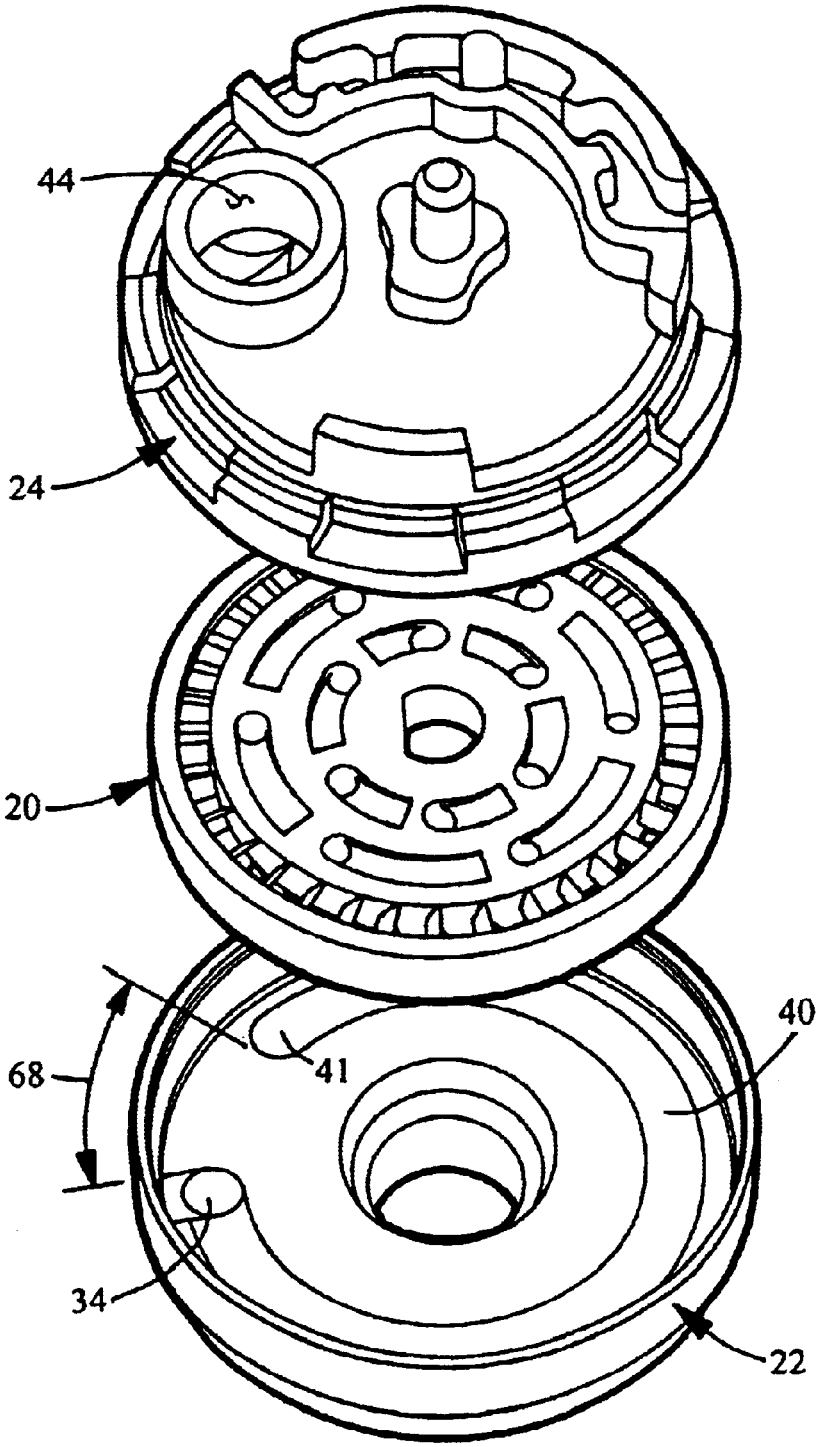
FIG. 5 is an exploded view of the pump body, impeller and pump cover of the fuel pump shown in FIG. 1.

Referring to FIG. 5, the pump body 22 includes a stripper area 68. The body channel 40 of the pump body 22 includes a channel inlet 41, and extends annularly from the channel inlet 41 around the pump body 22 to the fuel outlet 34. The stripper area 68 is defined as the area between the channel inlet 41 of the body channel 40 and the fuel outlet 34 extending annularly from the channel inlet 41 of the body channel 40 away from the body channel 40 to the fuel outlet 34. Preferably, the circumferential distance between any two adjacent vanes 50 of the first radial height is less than one-half the circumferential width of the stripper area 68. If the distance between two adjacent vanes 50 of the first radial height is more than one-half of the circumferential width of the stripper area 68, then leakage can occur between the channel inlet 41 of the body channel 40 and the fuel outlet 34.

The impeller 20 is preferably injection molded from a plastic material, such as phenolic, acetyl, PPS, or other plastics. It is to be understood that the impeller 20 could also be made from non-plastic materials known to those skilled in the art such as aluminum or steel. The fuel pump 10 can be mounted within a fuel tank (not shown) or, alternatively, can be mounted in-line between the fuel tank and the engine of the vehicle.

The foregoing discussion discloses and describes two preferred embodiments of the invention. One skilled in the art will readily recognize from such discussion, and from the accompanying drawings and claims, that changes and modifications can be made to the invention without departing from the scope of the invention as defined in the following claims. The invention has been described in an illustrative manner, and it is to be understood that the terminology which has been used is intended to be in the nature of words of description rather than of limitation.

What is claimed is:

1. An impeller for a fuel pump for supplying fuel to an automotive engine from a fuel tank comprising:

an impeller body having a substantially disk shape with opposing first and second faces and an outer circumference, said impeller body defining a rotational axis extending therethrough perpendicular to said first and second faces;

a plurality of radially outwardly extending vanes extending from said outer circumference of said impeller body and spaced circumferentially about said impeller body, each of said vanes including a first half extending from said outer circumference adjacent said first face and a second half extending from said outer circumference adjacent said second face, said second halves being rotationally shifted about said rotational axis relative to said first halves, said vanes being spaced un-evenly in a non-repeating pattern about said outer circumference of said impeller body;

a first portion of said vanes having a first height such that said vanes of said first portion extend radially outward from said outer circumference of said impeller body, and a second portion of said vanes having a second height less than said first height;

said vanes having said first height and said vanes having said second height being intermingled in a non-repeating pattern circumferentially about said outer circumference of said impeller body.

2. The impeller of claim 1 wherein the number of vanes is a prime number.

3. The impeller of claim 1 wherein the number of vanes having said first height is a prime number.

4. The impeller of claim 3 wherein the impeller is adapted to be housed within a pump housing having a pump cover and a pump body, wherein the pump body includes an outlet, an outlet channel extending annularly about the pump body and feeding into the outlet, and a stripper area which is defined as the circumferential area between a beginning of the outlet channel and the outlet, the circumferential distance between any two adjacent vanes having said first height being less than the circumferential width of the stripper area of the pump body.

5. The impeller of claim 1 further including an outer ring extending circumferentially around said impeller and being attached to distal ends of said plurality of vanes.

6. The impeller of claim 5 wherein a first portion of said vanes have a first height such that said vanes of said first portion extend radially outward from said outer circumference of said impeller body and connect with said outer ring, and a second portion of said vanes have a second height, less than said first height, much that said vanes of said second portion do not connect with said outer ring.

7. The impeller of claim 1 wherein said second halt of each of said vanes is rotationally shifted toward a next adjacent vane such that said second half is shifted approximately one half the distance between said first half of that vane and said first halt of said next adjacent vane.

8. The impeller of claim 1 wherein said second height is approximately two thirds the first height.

9. The impeller of claim 1 wherein said first and second halves of each of said vanes have a substantially similar radial height.

10. The impeller of claim 9 wherein each vane further includes a radially outwardly extending connector wall, extending radially outward from said outer circumference of said impeller body and extending circumferentially between said first and second halves.

11. The impeller of claim 10 wherein each of said connector walls has a radial height substantially similar to said first and second halves between which the connector wall extends.

12. A fuel pump for supplying fuel to an automotive engine from a fuel tank comprising:

a pump housing;

a motor mounted within said housing and having a shaft extending therefrom;

a pump body mounted within said housing having a bore through which said shaft extends and an outlet channel portion of an annular pumping chamber with a fuel outlet at an end thereof;

an impeller including an impeller body having a substantially disk shape with opposing first and second faces and an outer circumference, said impeller body defining a rotational axis extending therethrough perpendicular to said first and second faces, said impeller further including a plurality of radially outwardly extending vanes extending from said outer circumference of said impeller body and spaced circumferentially about said impeller body, each of said vanes including a first half extending from said outer circumference adjacent said first face and a second half extending from said outer circumference adjacent said second face, said second halves being rotationally shifted about said rotational axis relative to said first halves, said vanes being spaced un-evenly and in a non-repeating pattern about said outer circumference of said impeller body; and a pump cover mounted on an end of said housing and attached to said pump bottom with said impeller therebetween and having a cover channel portion of an annular pumping chamber with a pump inlet, said pump cover and pump bottom cooperating to form a complete pumping chamber for said impeller;

a first portion of said vanes having a first height such that said vanes of said first portion extend radially outward from said outer circumference of said impeller body, and a second portion of said vanes having a second height, less than said first height;

said vanes having said first height and said vanes having said second height being intermingled in a non-repeating pattern circumferentially about said outer circumference of said impeller body.

13. The fuel pump of claim 12 wherein the number of vanes extending from said outer circumference of said impeller is a prime number.

14. The fuel pump of claim 12 wherein the number of vanes having said first height is a prime number.

15. The fuel pump of claim 14 wherein said outlet channel of said pump body includes a first end and extends annularly about said pump body from said first end to said fuel outlet of said pump body, said pump body further including a stripper area which is defined as the circumferential area between said first end of said outlet channel and the outlet, the circumferential distance between any two adjacent vanes of said impeller which have said first radial height being less than the circumferential width of said stripper area of the pump body.

16. The fuel pump of claim 12 wherein said impeller further includes an outer ring extending circumferentially around said impeller and being attached to distal ends of said plurality of vanes.

17. The fuel pump of claim 16 wherein a first portion of said vanes have a first height such that said vanes of said first portion extend radially outward from said outer circumference of said impeller body and connect with said outer ring, and a second portion of said vanes have a second height, less than said first height, such that said vanes of said second portion do not connect with said outer ring.

18. The fuel pump of claim 12 wherein said second half of each of said vanes is rotationally shifted toward a next adjacent vane such that said second half is shifted approximately one half the distance between said first half of that vane and said first half of said next adjacent vane.

19. The fuel pump of claim 12 wherein said second height is approximately two thirds the first height.

20. The fuel pump of claim 12 wherein said first and second halves of each of said vanes have a substantially similar radial height.

21. The fuel pump of claim 20 wherein each vane further includes a radially outwardly extending connector wall, extending radially outward from said outer circumference of said impeller body and extending circumferentially between said first and second halves.

22. The fuel pump of claim 21 wherein each of said connector walls has a radial height substantially similar to said first and second halves between which the connector wall extends.

* * * * *

UNITED STATES PATENT AND TRADEMARK OFFICE

CERTIFICATE OF CORRECTION

PATENT NO. : 6,824,361 B2
DATED : November 30, 2004
INVENTOR(S) : DeQuan Yu et al.

It is certified that error appears in the above-identified patent and that said Letters Patent is hereby corrected as shown below:

Title page,
Item [75], Inventor, delete "Stephan" and substitute -- Stephen -- in its place.

Column 4,
Line 30, after "height," delete "much" and substitute -- such -- in its place.
Line 32, after "second" delete "halt" and substitute -- half -- in its place.

Signed and Sealed this

Thirty-first Day of May, 2005

JON W. DUDAS
*Director of the United States Patent and Trademark Office*